US011784410B2

(12) United States Patent
Wu et al.

(10) Patent No.: US 11,784,410 B2
(45) Date of Patent: Oct. 10, 2023

(54) ANTENNA MODULE

(71) Applicant: PEGATRON CORPORATION, Taipei (TW)

(72) Inventors: Chien-Yi Wu, Taipei (TW); Sheng-Chin Hsu, Taipei (TW); Chao-Hsu Wu, Taipei (TW); Shih-Keng Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 81 days.

(21) Appl. No.: 17/672,489

(22) Filed: Feb. 15, 2022

(65) Prior Publication Data

US 2022/0344815 A1 Oct. 27, 2022

(30) Foreign Application Priority Data

Apr. 27, 2021 (TW) ..... 110115133

(51) Int. Cl.
*H01Q 5/357* (2015.01)
*H01Q 9/42* (2006.01)

(52) U.S. Cl.
CPC ..... *H01Q 5/357* (2015.01); *H01Q 9/42* (2013.01)

(58) Field of Classification Search
CPC ..... H01Q 5/30; H01Q 5/307; H01Q 5/342; H01Q 5/357; H01Q 9/42
See application file for complete search history.

(56) References Cited

U.S. PATENT DOCUMENTS 5,995,064 A * 11/1999 Yanagisawa ..... H01Q 9/42 343/702
6,130,651 A * 10/2000 Yanagisawa ..... H01Q 9/42 343/702
6,320,545 B1 * 11/2001 Nagumo ..... H01Q 1/36 343/702
8,786,512 B2 7/2014 Shih et al.
9,209,520 B2 12/2015 Oon et al.
2003/0169209 A1 * 9/2003 Ohara ..... H01Q 1/242 343/702
2007/0001913 A1 * 1/2007 Tsai ..... H01Q 5/371 343/702
2010/0053456 A1 * 3/2010 Rowell ..... G06F 1/1698 343/702

(Continued)

FOREIGN PATENT DOCUMENTS

TW 201128859 8/2011

*Primary Examiner* — Ab Salam Alkassim, Jr.
*Assistant Examiner* — Leah Rosenberg
(74) *Attorney, Agent, or Firm* — J.C. PATENTS

(57) ABSTRACT

An antenna module includes a first radiator, a ground plane and a second radiator. The first radiator includes a first section and a second section. The first section includes a first end and a second end. The first end is a feeding end, and the second end is connected to the second section. The first section includes first parts bent back and forth along a first direction, the second section includes second parts bent back and forth along a second direction, and an included angle formed between the first direction and the second direction is 60 degrees to 120 degrees. The ground plane is disposed beside the first section of the first radiator. An end of the second radiator is connected to the feeding end of the first radiator, and the other end of the second radiator is vertically connected to the ground plane.

10 Claims, 4 Drawing Sheets

(56) References Cited

U.S. PATENT DOCUMENTS

| | | | | |
|---|---|---|---|---|
| 2011/0199265 | A1* | 8/2011 | Lin | H01Q 5/378<br>343/700 MS |
| 2013/0207856 | A1* | 8/2013 | Oon | H01Q 21/28<br>343/729 |
| 2019/0273311 | A1* | 9/2019 | Sampo | H01Q 21/29 |

* cited by examiner

ANTENNA MODULE

CROSS-REFERENCE TO RELATED APPLICATION

This application claims the priority benefit of Taiwanese application no. 110115133, filed on Apr. 27, 2021. The entirety of the above-mentioned patent application is hereby incorporated by reference herein and made a part of this specification.

BACKGROUND

Technology Field

The disclosure relates to an antenna module, and in particular, to an antenna module.

Description of Related Art

Since a conventional LoRa (Long Range) antenna has to cover the frequency band of 443 MHz in Europe and the frequency bands 433.05 MHz to 434.79 MHz and 470 MHz to 510 MHz in China, the antenna was designed with a coupling model in the past. The antenna has to occupy larger space and a larger clearance area to achieve the wideband characteristic. However, the antenna is not easy to be designed due to a space restriction of a small device.

SUMMARY

The disclosure is directed to an antenna module having a smaller size and a wideband characteristic through a special design.

The antenna module of the disclosure includes a first radiator, a ground plane, and a second radiator. The first radiator includes a first section and a second section. The first section includes a first end and a second end. The first end is a feeding end, and the second end is connected to the second section. The first section includes multiple first parts bent back and forth along a first direction, and the second section includes multiple second parts bent back and forth along a second direction. An included angle formed between the first direction and the second direction is 60 degrees to 120 degrees. The ground plane is disposed beside the first section of the first radiator. An end of the second radiator is connected to the feeding end of the first radiator, and the other end of the second radiator is vertically connected to the ground plane.

In an embodiment of the disclosure, multiple first coupling gaps are formed between one another the first parts, and multiple second coupling gaps are formed between one another the second parts.

In an embodiment of the disclosure, a third coupling gap is formed between the first section of the first radiator and the second radiator. A fourth coupling gap is formed between at least one of the second parts and the first part closest thereto. The fourth coupling gap is larger than each of the first coupling gaps, each of the second coupling gaps, and the third coupling gap.

In an embodiment of the disclosure, a length of the first section is half a length of the second section.

In an embodiment of the disclosure, a length of the second radiator is half the length of the first section.

In an embodiment of the disclosure, a width of the first section is less than a width of the second section.

In an embodiment of the disclosure, the antenna module excites at a frequency. A length of the first radiator is a quarter of a wavelength of the frequency.

In an embodiment of the disclosure, the second radiator includes a first portion, a second portion, and a third portion sequentially connected. The end of the second radiator is located at the first portion, and the first portion is connected to the feeding end through the end of the second radiator. The second portion is a patch. The other end of the second radiator is located at the third portion and is away from the second portion. The third portion is vertically connected to the ground plane through the other end of the second radiator.

In an embodiment of the disclosure, the third portion is bent back and forth between a direction approaching the first portion and a direction away from the first portion.

In an embodiment of the disclosure, the first radiator, the second radiator, and the ground plane are located at the same plane.

Based on the above, the first radiator of the antenna module of the disclosure includes the first section and the second section. The first end of the first section is the feeding end, and the second end of the first section is connected to the second section. The first section includes the multiple first parts bent back and forth along the first direction, and the second section includes the multiple second parts bent back and forth along the second direction. The included angle formed between the first direction and the second direction is 60 degrees to 120 degrees. The ground plane is disposed beside the first section of the first radiator. The end of the second radiator is connected to the feeding end of the first radiator, and the other end of the second radiator is vertically connected to the ground plane. The antenna module of the disclosure may achieve a wideband effect and have the smaller size to be applied to a device with a small size through the design above.

DETAILED DESCRIPTION

Figure 1:
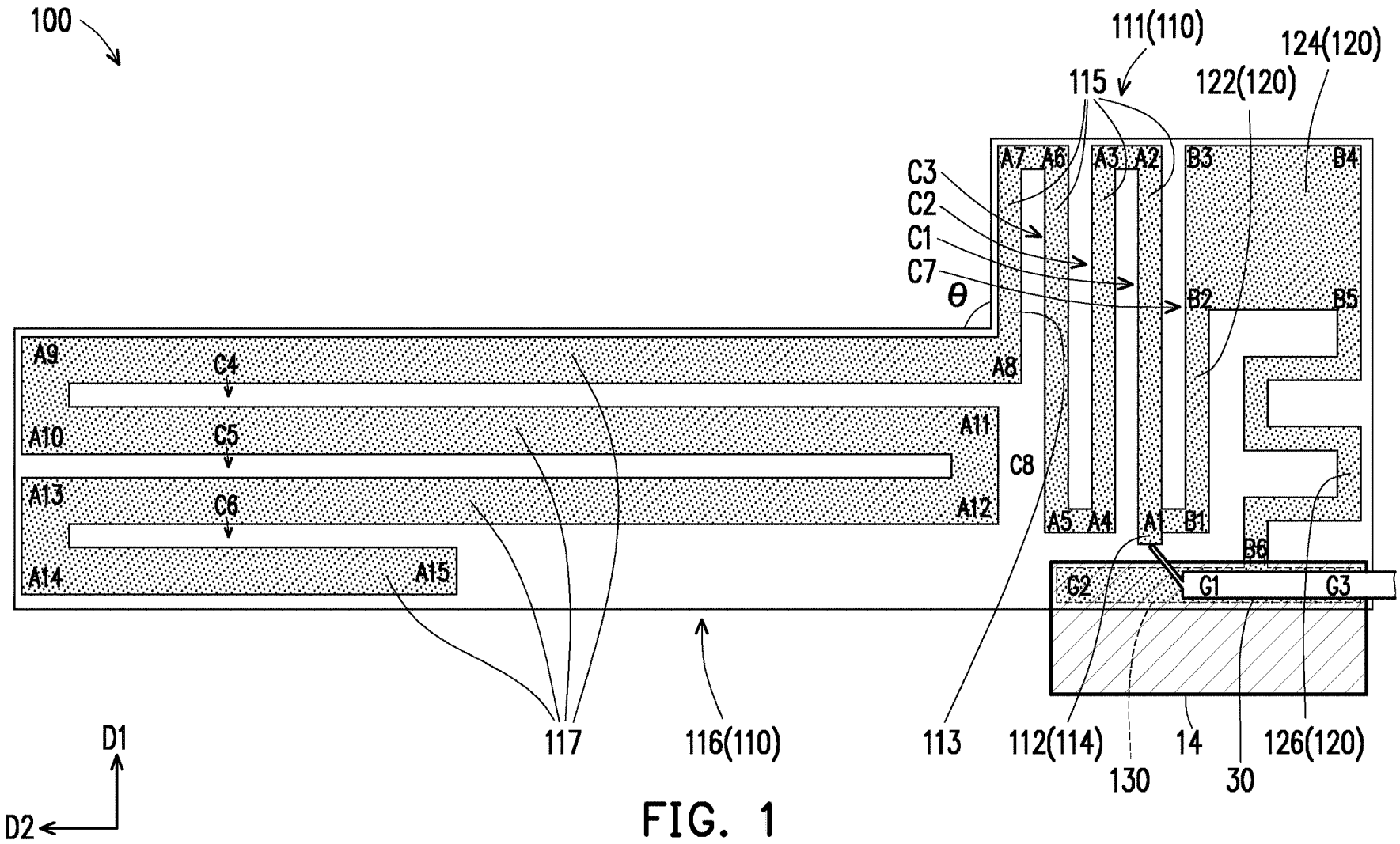
FIG. 1 is a schematic diagram of an antenna module according to an embodiment of the disclosure.

FIG. 1 is a schematic diagram of an antenna module according to an embodiment of the disclosure. Referring to FIG. 1, an antenna module 100 of the embodiment includes a first radiator 110, a ground plane 130, and a second radiator 120. In the embodiment, the first radiator 110, the second radiator 120, and the ground plane 130 are located at the same plane.

The first radiator 110 includes a first section 111 (positions A1 to A8) and a second section 116 (positions A8 to A15). The first section 111 includes multiple first parts 115 (the positions A1A2, A3A4, A5A6, and A7A8) bent back and forth along a first direction D1. Multiple first coupling gaps C1, C2, and C3 are formed between one another the first parts 115. The first coupling gaps C1, C2, and C3 range from 0.5 mm to 1.5 mm, such as 1 mm.

The first section 111 includes a first end 112 (the position A1) and a second end 113 (the position A8). The first end 112 is a feeding end 114, and the second end 113 is connected to the second section 116.

An included angle θ formed between the first direction D1 and a second direction D2 is 60 degrees to 120 degrees, such as 90 degrees, so that the first section 111 and the second section 116 are L-shaped. With a range of the angle above, a bandwidth may be increased.

The second section 116 includes multiple second parts 117 (the positions A8A9, A10A11, A12A13, and A14A15) bent back and forth along the second direction D2.

Multiple second coupling gaps C4, C5, and C6 are formed between one another the second parts 117 of the second section 116. The second coupling gaps C4, C5, and C6 range from 0.5 mm to 1.5 mm, such as 1 mm.

In addition, a third coupling gap C7 is formed between the first section 111 (located at the positions A1A2) of the first radiator 110 and the second radiator 120 (located at positions B2B3). The third coupling gap C7 ranges from 0.5 mm to 1.5 mm, such as 1 mm. The third coupling gap C7 is configured to maintain a certain distance between a path of the positions A1 and A2 and a path of the positions B2 and B3 to enhance impedance matching of the antenna.

In addition, in the embodiment, a fourth coupling gap C8 is formed between at least one of the second parts 117 and the first part 115 closest thereto. Specifically, the fourth coupling gap C8 is formed between the positions A11 and A12 and the positions A5 and A6. In the embodiment, the fourth coupling gap C8 is larger than each of the first coupling gaps C1 to C3, each of the second coupling gaps C4 to C6, and the third coupling gap C7. The fourth coupling gap C8 ranges from 1.5 mm to 2.5 mm, such as 2 mm. The fourth coupling gap C8 is configured to maintain a certain distance between a path of the positions A11 and A12 and a path of the positions A5 and A6 to enhance the antenna efficiency and a bandwidth.

In the embodiment, the antenna module 100 excites at a frequency, such as 433 MHz to 510 MHz of a LoRa antenna. A length of the first radiator 110 is a quarter of a wavelength of the frequency. In addition, a length of the first section 111 of the first radiator 110 is half a length of the second section 116. That is, the length of the first section 111 of the first radiator 110 is one-twelfth of the wavelength of the frequency. The length of the second section 116 of the first radiator 110 is one-sixth of the wavelength of the frequency.

In addition, a width of the first section 111 of the first radiator 110 is less than a width of the second section 116. In the embodiment, the second section 116 away from the feeding end 114 has the greater width so that the antenna exhibits more favorable characteristics.

As shown in FIG. 1, the ground plane 130 (positions G1 to G3) is disposed beside the first section 111 of the first radiator 110. In the embodiment, a left edge of the ground plane 130 does not exceed a left edge of the first section 111 of the first radiator 110 located at the position A5, keeping a certain distance from the second section 116 to avoid affecting the characteristics of the antenna.

In addition, the left edge of the ground plane 130 is between the positions A4 and A5 without being too close to the feeding end 114 (the position A1) so that the ground plane 130 has a sufficient area. Furthermore, the ground plane 130 is bonded to the system ground plane 130 through ground copper foil 14. In addition, a positive end of a coaxial transmission cable 30 is connected to the feeding end 114 (the position A1), and a negative end of the coaxial transmission cable 30 is connected to the ground end G1.

Figure 2:
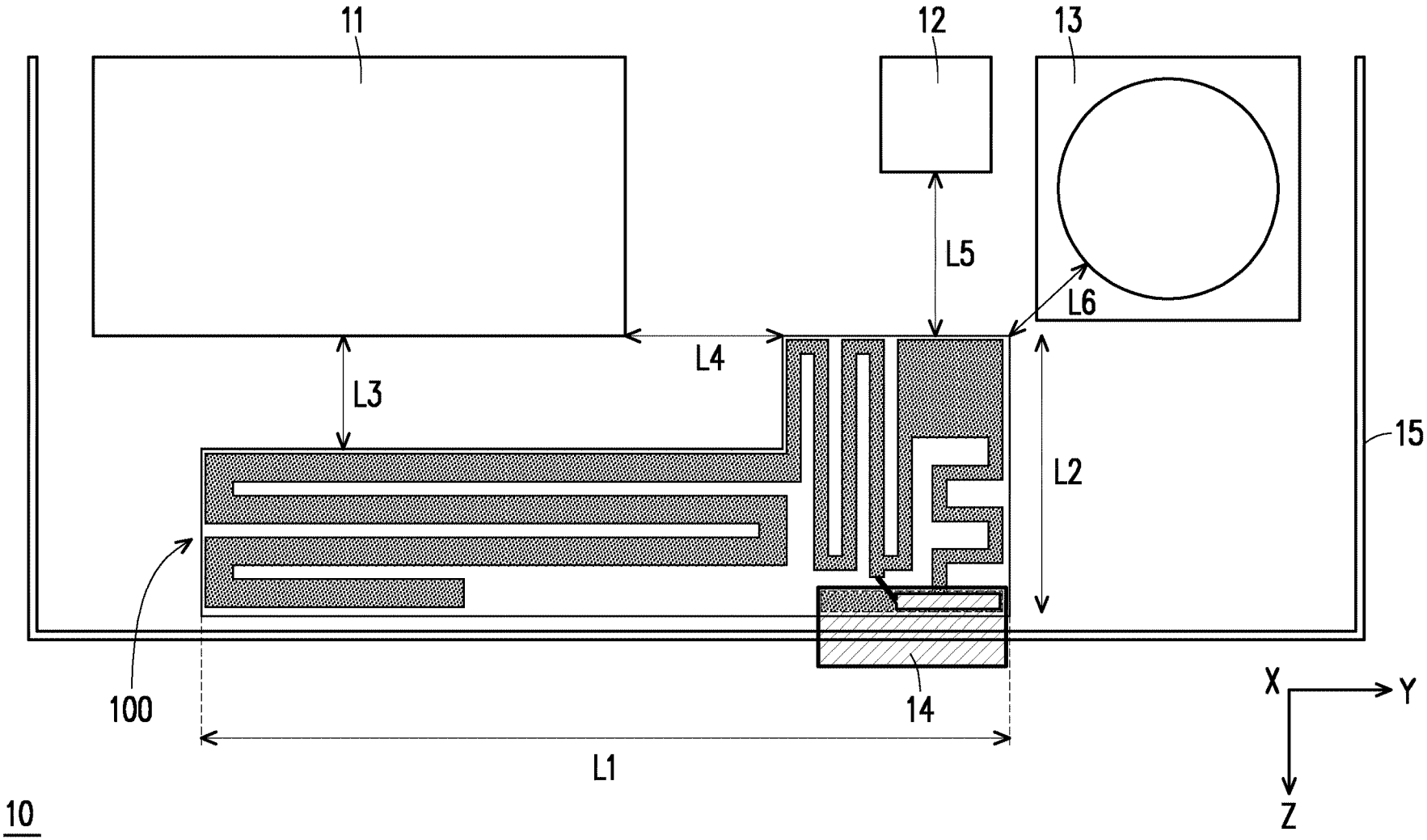
FIG. 2 is a schematic diagram of the antenna module of FIG. 1 disposed in an electronic device.

Furthermore, an end of the second radiator 120 (a position B1) is connected to the feeding end 114 of the first radiator 110, and the other end (a position B6) of the second radiator 120 is vertically connected to the ground plane 130. Specifically, the second radiator 120 includes a first portion 122, a second portion 124, and a third portion 126 sequentially connected. This end (the position B1) of the second radiator 120 is located at the first portion 122. The first portion 122 is connected to the feeding end 114 through this end (the position B1) of the second radiator 120 and extends along the first direction D1. The second portion 124 is a patch. Referring to FIG. 2 together, the second portion 124 of the second radiator 120 may be close to an NFC Tag antenna 13. The second portion 124 of the second radiator 120 has a larger area to avoid the antenna module 100 being disturbed by the NFC Tag antenna 13 so that the antenna module 100 has the more favorable antenna characteristics and impedance matching.

The third portion 126 is located between the second portion 124 and the ground plane 130 and is bent back and forth between a direction (a direction D2) approaching the first portion 122 and a direction away from the first portion 122. With this design, the part of the third portion 126 close to the first portion 122 is reduced so that favorable impedance matching may be provided.

The other end (the position B6) of the second radiator 120 is located at the third portion 126 and is away from the second portion 124. The third portion 126 is vertically connected to the ground plane 130 through the other end (the position B6) of the second radiator 120. Compared to a conventional PIFA antenna grounded parallel to the edge of the ground plane 130, in the embodiment, the third portion 126 of the second radiator 120 is grounded perpendicular to the edge of the ground plane 130. In the design of vertical grounding, an antenna radiation ground path may be reduced to save more space for an antenna pattern and allow more freedom and flexibility for an antenna pattern design. In addition, a path formed by the positions B1, B2, B5, and B6 may loop and form an F-shaped ground structure so that the position B1 is aligned with the position G1 and more radiation space is available at a left side of the position A1. Furthermore, in the embodiment, a length of the second radiator 120 is half the length of the first section 111 so that favorable impedance matching is provided.

The antenna module 100 of the disclosure may achieve a wideband effect without being affected by surrounding components and can be applied to a device with a small size through the design above.

Figure 3:
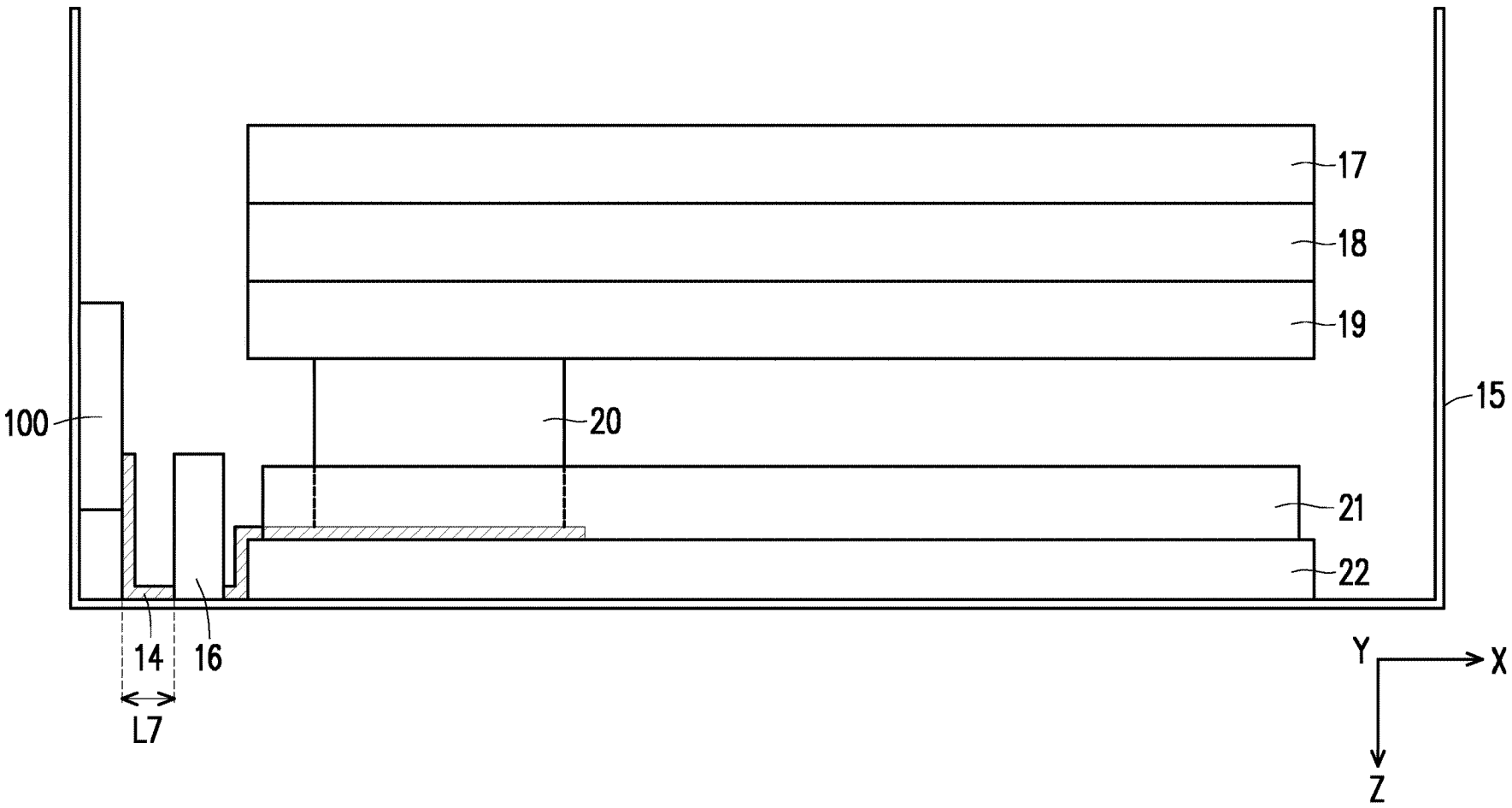
FIG. 3 is a schematic diagram of FIG. 2 from another perspective.

FIG. 2 is a schematic diagram of the antenna module of FIG. 1 disposed in an electronic device. FIG. 3 is a schematic diagram of FIG. 2 from another perspective. Note that the viewing angle of FIG. 2 is a viewing angle from the YZ plane in the X direction, and the viewing angle of FIG. 3 is a viewing angle from the XZ plane in the Y direction.

Referring to FIG. 2 and FIG. 3, in the embodiment, an electronic device 10 is, for example, a small remote storage device. A length of the entire device is approximately 214 mm. A width of the entire device is approximately 136 mm. A height of the entire device is approximately 68 mm. A length L1 of the antenna module 100 is approximately 60 mm, and a width L2 of the antenna module 100 is approximately 20 mm, which is a small size.

The antenna module 100 is surrounded by multiple structures with metal. For example, a distance L3 and a distance L4 from the antenna module 100 to a power board 11 are approximately 10 mm. A distance L5 from the antenna module 100 to a magnet 12 is approximately 10 mm. A distance L6 from the antenna module 100 to the NFC Tag antenna 13 is approximately 10 mm. A distance L7 (FIG. 3) from the antenna module 100 to a switch board 16 is approximately 10 mm.

As shown in FIG. 3, the antenna module 100 is attached to an inner side wall of a plastic housing 15 and is connected to the ground copper foil 14. The ground copper foil 14 is disposed along the plastic housing 15 and a back lid of a touch panel 22 (e.g. a panel of electronic paper) and across the switch board 16. A heat dissipation conductor 21 (e.g. heat dissipation copper foil) is disposed at the back of the touch panel 22 to dissipate heat for the touch panel 22. The ground copper foil 14, conductive foam 20, and a hard disc 19, and a metal frame 18 and a motherboard 17 are connected to each other and jointly serve as a complete system ground plane so that the antenna module 100 has a large system ground plane.

Figure 4:
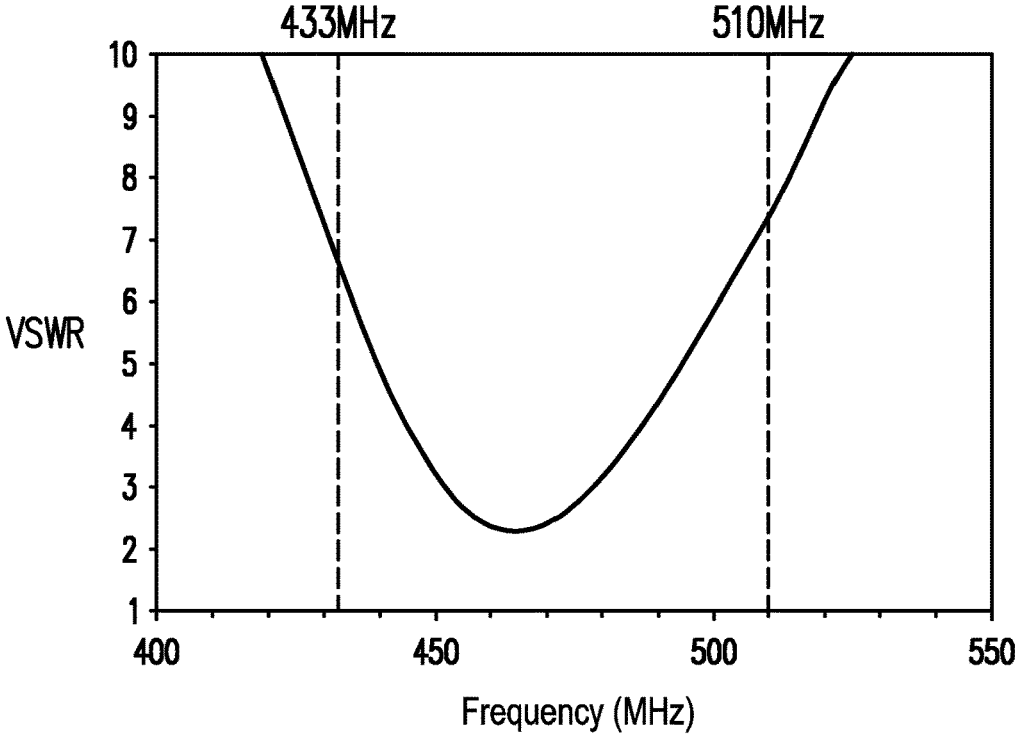
FIG. 4 is a schematic diagram illustrating a relation between a frequency and VSWR of the antenna module in FIG. 1.

FIG. 4 is a schematic diagram illustrating a relation between a frequency and VSWR of the antenna module in FIG. 1. Referring to FIG. 4, in the embodiment, the VSWR of the antenna module 100 at the frequency of 433 MHz to 510 MHz may be below 8 so that a favorable performance is provided.

Figure 5:
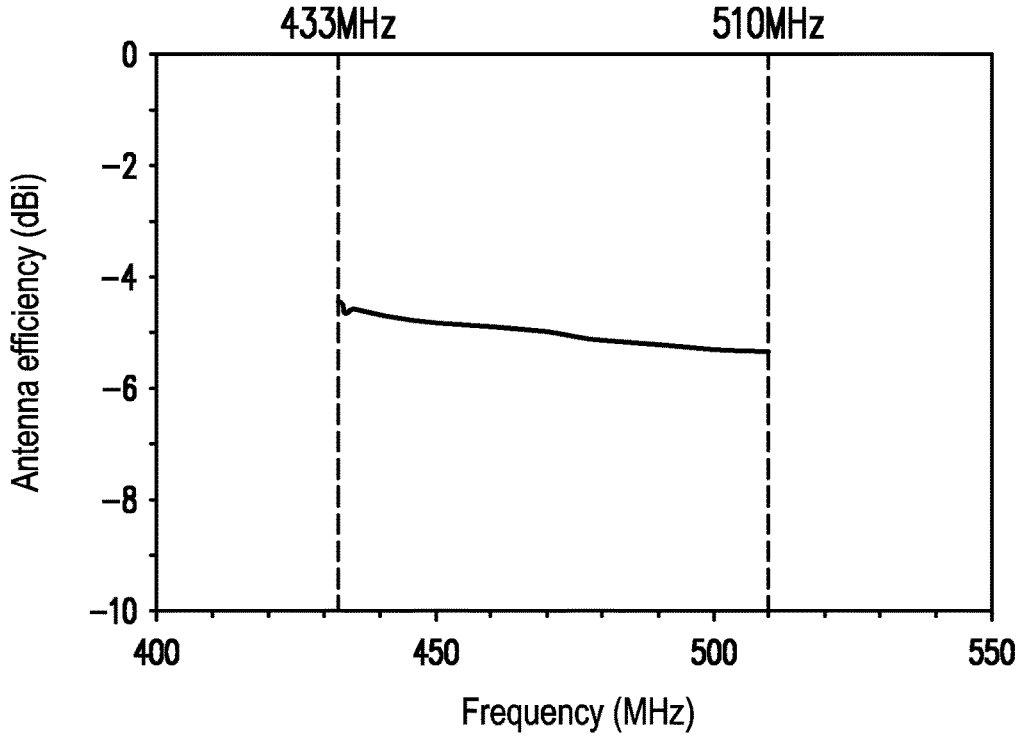
FIG. 5 is a schematic diagram illustrating a relation between a frequency and antenna efficiency of the antenna module in FIG. 1.

FIG. 5 is a schematic diagram illustrating a relation between a frequency and antenna efficiency of the antenna module in FIG. 1. Referring to FIG. 5, in the embodiment, the antenna efficiency of the antenna module 100 at the frequency of 433 MHz to 510 MHz may be −4.4 dBi to −5.3dBi so that the favorable performance is provided.

In summary the above, the first radiator of the antenna module of the disclosure includes the first section and the second section. The first end of the first section is the feeding end, and the second end of the first section is connected to the second section. The first section includes the multiple first parts bent back and forth along the first direction, and the second section includes the multiple second parts bent back and forth along the second direction. The included angle formed between the first direction and the second direction is 60 degrees to 120 degrees. The ground plane is disposed beside the first section of the first radiator. The end of the second radiator is connected to the feeding end of the first radiator, and the other end of the second radiator is vertically connected to the ground plane. The antenna module of the disclosure may achieve the wideband effect and have the smaller size and can be applied to the device with the small size through the design above.

What is claimed is:

1. An antenna module, comprising:

a first radiator comprising a first section and a second section, wherein the first section comprises a first end and a second end, the first end is a feeding end, the second end is connected to the second section, the first section comprises a plurality of first parts bent back and forth along a first direction, the second section comprises a plurality of second parts bent back and forth along a second direction, and an included angle formed between the first direction and the second direction is 60 degrees to 120 degrees;

a ground plane disposed beside the first section of the first radiator; and a second radiator, wherein an end of the second radiator is connected to the feeding end of the first radiator, and the other end of the second radiator is vertically connected to the ground plane.

2. The antenna module according to claim 1, wherein a plurality of first coupling gaps are formed between one another the first parts, and a plurality of second coupling gaps are formed between one another the second parts.

3. The antenna module according to claim 2, wherein a third coupling gap is formed between the first section of the first radiator and the second radiator, a fourth coupling gap is formed between at least one of the second parts and the first part closest thereto, and the fourth coupling gap is larger than each of the first coupling gaps, each of the second coupling gaps, and the third coupling gap.

4. The antenna module according to claim 1, wherein a length of the first section is half a length of the second section.

5. The antenna module according to claim 1, wherein a length of the second radiator is half a length of the first section.

6. The antenna module according to claim 1, wherein a width of the first section is less than a width of the second section.

7. The antenna module according to claim 1, wherein the antenna module excites at a frequency, and a length of the first radiator is a quarter of a wavelength of the frequency.

8. The antenna module according to claim 1, wherein the second radiator comprises a first portion, a second portion, and a third portion sequentially connected, the end of the second radiator is located at the first portion, the first portion is connected to the feeding end through the end of the second radiator, the second portion is a patch, the other end of the second radiator is located at the third portion and is away from the second portion, and the third portion is vertically connected to the ground plane through the other end of the second radiator.

9. The antenna module according to claim 8, wherein the third portion is bent back and forth between a direction approaching the first portion and a direction away from the first portion.

10. The antenna module according to claim 1, wherein the first radiator, the second radiator, and the ground plane are located at the same plane.

* * * * *